US006503045B2

(12) United States Patent
Arrez et al.

(10) Patent No.: US 6,503,045 B2
(45) Date of Patent: Jan. 7, 2003

(54) REFUSE CONTAINER LIFTER

(75) Inventors: Ramiro Arrez, Chicago, IL (US); Carlos Arrez, Berwyn, IL (US)

(73) Assignee: Perkins Manufacturing Company, La Grange, IL (US)

( * ) Notice: Subject to any disclaimer, the term of this patent is extended or adjusted under 35 U.S.C. 154(b) by 0 days.

(21) Appl. No.: 09/731,946

(22) Filed: Dec. 7, 2000

(65) Prior Publication Data

US 2002/0071748 A1 Jun. 13, 2002

Related U.S. Application Data

(60) Provisional application No. 60/170,204, filed on Dec. 10, 1999.

(51) Int. Cl.[7] ..... B65F 3/00; B65F 3/02

(52) U.S. Cl. ..... 414/408; 414/421

(58) Field of Search ..... 414/406, 408, 414/421

(56) References Cited

U.S. PATENT DOCUMENTS

| | | | | | |
|---|---|---|---|---|---|
| 3,032,216 | A | * | 5/1962 | McCarthy | 214/302 |
| 3,327,876 | A | | 6/1967 | Kolling | |
| 3,730,365 | A | * | 5/1973 | Herpich et al. | 214/302 |
| 3,732,997 | A | * | 5/1973 | Reavis et al. | 214/302 |
| 3,738,516 | A | * | 6/1973 | Wells | 214/302 |
| 3,747,785 | A | | 7/1973 | Dahlin | |
| 3,804,277 | A | | 4/1974 | Brown et al. | |
| 3,823,973 | A | | 7/1974 | Ramer | |
| 3,884,376 | A | | 5/1975 | Rivers | |
| 3,894,642 | A | | 7/1975 | Shive | |
| 3,931,901 | A | | 1/1976 | Jones | |
| 4,042,137 | A | | 8/1977 | Hughes et al. | |
| 4,365,922 | A | | 12/1982 | Borders | |
| 4,422,814 | A | * | 12/1983 | Borders | 414/303 |
| 4,479,751 | A | * | 10/1984 | Wyman et al. | 414/406 |
| 4,613,271 | A | * | 9/1986 | Naab | 414/303 |

(List continued on next page.)

FOREIGN PATENT DOCUMENTS

| | | | | |
|---|---|---|---|---|
| AT | 243183 | | 2/1965 | |
| CA | 622499 | | 6/1961 | |
| CH | 358747 | | 1/1962 | |
| CH | 453203 | | 6/1968 | |
| DE | 811 456 | | 8/1951 | |
| DE | 844 262 | | 3/1952 | |
| DE | 1236403 | | 3/1967 | |
| DE | 2146653 | | 3/1973 | |
| DE | 3024081 | | 1/1981 | |
| EP | 575867 | * | 6/1993 | B65F/3/08 |
| FR | 2 272 002 | | 12/1975 | |
| FR | 2 459 779 | | 1/1981 | |
| FR | 2 449 783 | | 10/1981 | |
| FR | 2 500 425 | | 8/1982 | |
| GB | 291709 | | 6/1928 | |
| GB | 2078196 A | | 1/1982 | |
| GB | 2188302 | * | 3/1986 | B65F/3/04 |
| WO | WO 83/03242 | | 9/1983 | |

*Primary Examiner*—Kathy Matecki
*Assistant Examiner*—Sang Kim
(74) *Attorney, Agent, or Firm*—Cook, Alex, McFarron, Manzo, Cummings & Mehler, Ltd.

(57) ABSTRACT

A lifter including a motor which is secured to a base, the motor having a shaft rotatable about a first axis. At least one lift arm is secured to the rotatable shaft, with at least one actuator arm pivotally mounted to the base for rotation about a second axis displaced from the axis of the rotatable shaft. A carriage is provided that has two hooks for selectively engaging the spaced-apart bars that are on the container that is to be lifted, the hooks being selectively engageable with the bars so as to secure the container to the carriage during the dumping action. The first and second hooks are connected to each other by a telescoping member, one end of the telescoping member being rigidly connected to the lift arm and the other end of the telescoping member being pivotally connected to the actuator arm.

14 Claims, 5 Drawing Sheets

U.S. PATENT DOCUMENTS

| | | | | | |
|---|---|---|---|---|---|
| 4,673,327 | A | | 6/1987 | Knapp | |
| 4,687,405 | A | | 8/1987 | Olney | |
| 4,741,658 | A | * | 5/1988 | Zelinka et al. | 414/406 |
| 4,773,812 | A | | 9/1988 | Bayne et al. | |
| 4,911,600 | A | * | 3/1990 | Zelinka et al. | 414/408 |
| 5,024,573 | A | * | 6/1991 | Redding et al. | 414/408 |
| 5,026,241 | A | * | 6/1991 | Wyman | 414/303 |
| 5,069,593 | A | * | 12/1991 | Zelinka et al. | 414/408 |
| 5,257,877 | A | * | 11/1993 | Zelinka et al. | 414/408 |
| 5,308,211 | A | * | 5/1994 | Bayne | 414/408 |
| 5,333,984 | A | * | 8/1994 | Bayne et al. | 414/408 |
| 5,720,588 | A | * | 2/1998 | Graves | 414/406 |
| 6,167,795 | B1 | | 1/2001 | Bayne et al. | |

* cited by examiner

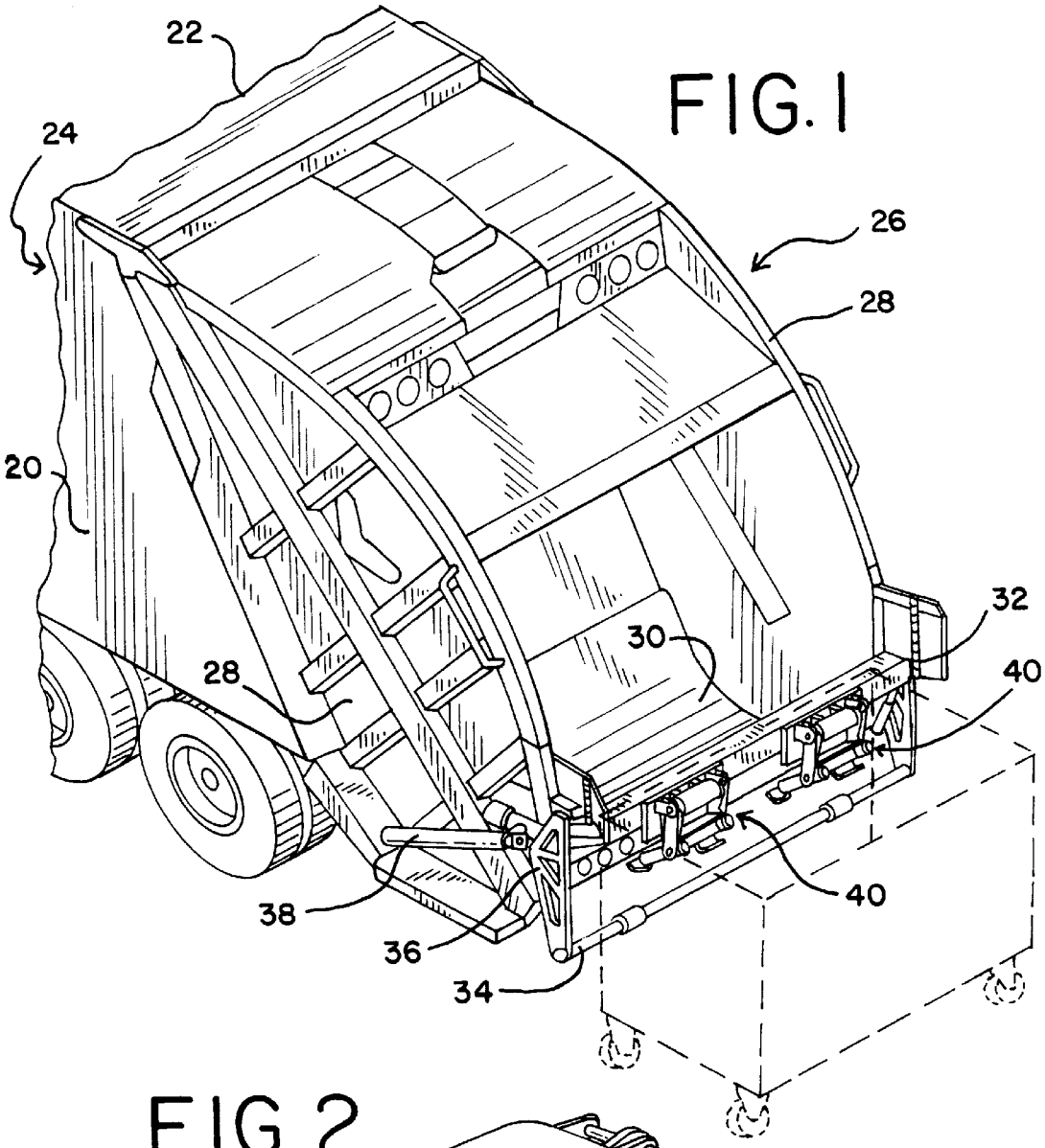
FIG. 1
FIG. 2
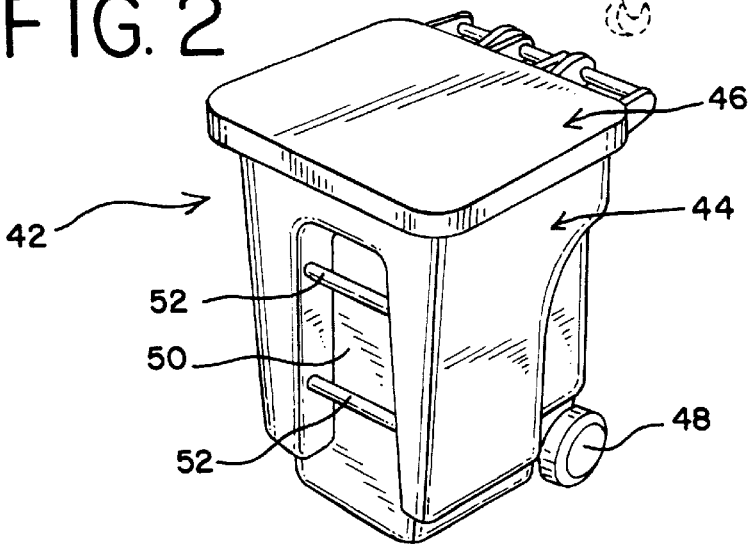

REFUSE CONTAINER LIFTER

CROSS REFERENCE TO RELATED APPLICATION

This application claims the benefit of the filing date of provisional application Ser. No. 60/170,204, filed Dec. 10, 1999.

BACKGROUND OF THE INVENTION

The present invention generally relates to lifters for refuse collection containers and, more specifically, to lifters for lifting, tilting and dumping residential-style refuse containers.

Refuse container lifters have been used for many years in a wide variety of settings. They have, for example, been mounted on refuse collection trucks, both rear and side load trucks. They have been mounted on larger multi-cubic yard refuse containers and they have been used in stationary refuse loading stations. An example of one successful refuse container lifter may be found in U.S. Pat. No. 4,741,658 to Zelinka and Redding. That patent is owned by the Perkins Manufacturing Company, which makes and sells a variety of lifters, including its well-known TuckAway lifter. Despite the wide variety of lifters being offered for sale, there continues to be need for lifters that have improved reliability and/or function; that are suitable for variety of applications on trucks, containers or stationary refuse collection stations; and/or that may be more efficiently manufactured at reduced cost.

Accordingly, it is an object of the present invention to provide a lifter for lifting, tilting and dumping residential-style refuse containers that has improved reliability.

It is a further object of the present invention to provide a refuse container that is adapted for use in a variety of applications, such as on trucks, containers, or stationary refuse collection stations and also does not interfere with the use of lifters for other types of containers.

It is a still further object of the present invention to provide a refuse container lifter that is simple in design so that it may be efficiently and economically manufactured.

SUMMARY OF THE INVENTION

These objects, and others which will become apparent upon reference to the following drawings and detailed description, are achieved by a lifter including a motor which is secured to a base, the motor having a shaft rotatable about a first axis. At least one lift arm is secured to the rotatable shaft, with at least one actuator arm pivotally mounted to the base for rotation about a second axis displaced from the axis of the rotatable shaft. A carriage is provided that has two hooks for selectively engaging the spaced-apart bars that are on the container that is to be lifted, the hooks being selectively engageable with the bars so as to secure the container to the carriage during the dumping action. The first and second hooks are connected to each other by a telescoping member, one end of the telescoping member being rigidly connected to the lift arm and the other end of the telescoping member being pivotally connected to the actuator arm. During the dumping action, the telescoping member extends, as the hooks engage the bars on the container. When the container is returned to its original position after having been dumped, the telescoping members collapse into a more compact relationship.

The carriage also comprises a first cross piece that is rigidly mounted to the lift arm on which one hook is mounted. A telescoping connecting member is rigidly secured to the lift arm and pivotally secured to the actuator arm, with a second cross piece rigidly connected to the telescoping connecting member and including a second hook for engaging the other of the bars on the container. In a preferred embodiment, the telescoping or connecting member includes an inner member and an outer member, with the outer member including an elongated slot sized so that at least a portion of the actuator arm retracts into the slot when the lifting arm is in its first, retracted position.

BRIEF DESCRIPTION OF THE DRAWINGS

FIG. 1 is perspective view of a refuse collection truck, partially removed, of a rear-loading refuse collection truck including two lifters in accordance with the present invention, and with a larger multi-cubic yard container shown in dashed lines.

FIG. 2 is a perspective view of a typical residential collection container used with the lifter of the present invention. The drawings of FIGS. 1 and 2 are not to the same scale, and the container in FIG. 2 is actually of much smaller capacity (e.g., 90 gallons) compared to the multi-cubic yard container in FIG. 1.

DETAILED DESCRIPTION OF THE PREFERRED EMBODIMENTS

Figure 3A:
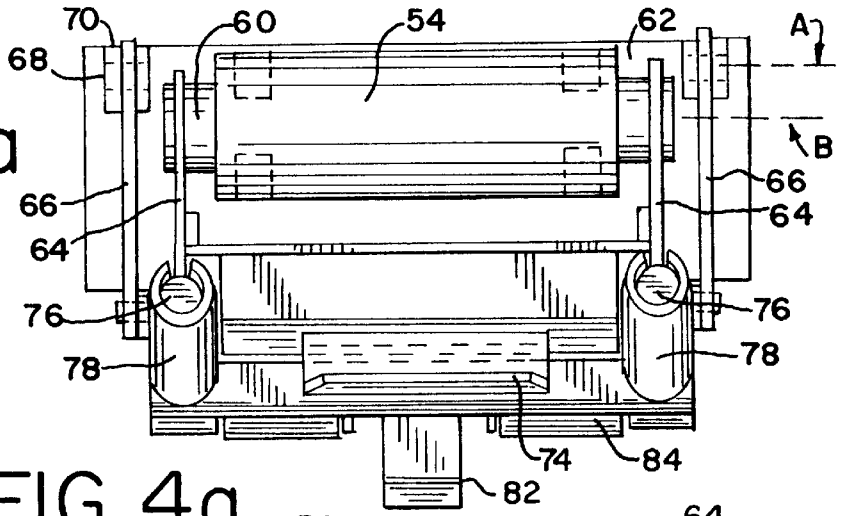
FIG. 3*a* is an elevational view of the lifter of FIG. 3.
Figure 4A:
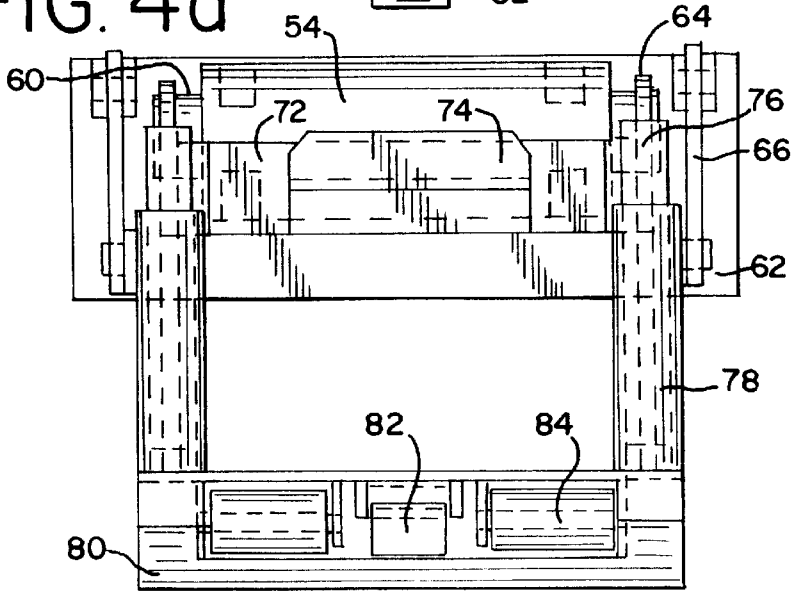
FIG. 4*a* is a front view of the lifter in FIG. 4.

FIG. 1 illustrates a typical rear loading refuse collection truck of the type having a pair of sidewalls 20, a top wall 22, and bottom wall (not shown) forming a refuse collection body, generally at 24. A rear load hopper assembly, generally at 26, is mounted at the back of the collection body and includes sidewalls 28 and a curved bottom hopper wall 30. The bottom hopper wall slopes upwardly toward a rearward sill or sill edge 32, over which refuse is dumped into the collection hopper.

The collection truck illustrated in FIG. 1 is adapted for dumping very large, multi-cubic yard containers, commonly referred to as dumpsters, one of which is shown in dashed lines in FIG. 1, as well as much smaller residential style containers (as shown for example in FIG. 2). For dumping the large containers a tipper or kick bar 34 is pivotally attached to the back of the truck by a bracket 36 that is rotated by a hydraulic cylinder 38. When a large container is to be dumped, the container is rolled into position adjacent the sill area of the collection truck. A trunnion bar, which extends along one edge of the container, is captured by a latching mechanism, such as is shown in U.S. Pat. No. 5,720,588, or in a slot that extends along the sill of the truck. The container is lifted and tilted by rotating it about the trunnion bar. In the illustrated truck, this is done by the tipper bar 34 which is rotated from under the truck and pushed against the front side of the container, lifting and tilting it. Other trucks have other mechanisms for lifting and tilting containers, such as a cable and winch.

For dumping smaller, residential style containers, the refuse collection truck in FIG. 1 includes two lifters 40 embodying the present invention mounted at the rear, although only one could also be used. The lifters 40 of the present invention are shown on the particular truck illustrated in FIG. 1 solely for purposes of illustration. The lifters of the present invention may also be used on trucks that use a cable and winch system for dumping large multi-yard containers or on trucks devoted solely to residential pick-up. In addition, lifters 40 may be used on side load trucks, (in which refuse is added through a side opening), may be mounted on the larger multi-yard containers (with suitable hydraulic attachments to a source of hydraulic fluid power), or may be mounted on stationary refuse dumping stations. As will be described in more detail later, the lifter 40 of the present invention may be advantageously used with tipper bar-equipped trucks because the lifter retracts to a size and position clear of the path of travel of the tipper bar, so as not to interfere with tipper operation when large multi-yard containers are being dumped.

Before turning to a more detailed description of the lifter 40, reference is made to FIG. 2, which shows a typical residential roll out container 42 for which the present lifter is intended. The typical container 42 is made of rigid plastic construction, with a body 44 and a hinged lid 46. A pair of wheels 48 allow the container to be conveniently moved curbside or to another pickup location. The front side of the container includes a generally recessed area 50 to accommodate lifter units on the refuse collection vehicle. For cooperation with such lifters, a pair of parallel, spaced-apart lift bars 52 are firmly secured in the container body in the area recessed 50. Lid 46 is hingedly connected to the body, so that the lid is naturally opened by gravity when the container is inverted for dumping. It should be understood that refuse collection containers of the type shown, are available in a variety of styles and designs, and the present invention is not limited to any particular type style or design of refuse collection container.

Figure 5A:
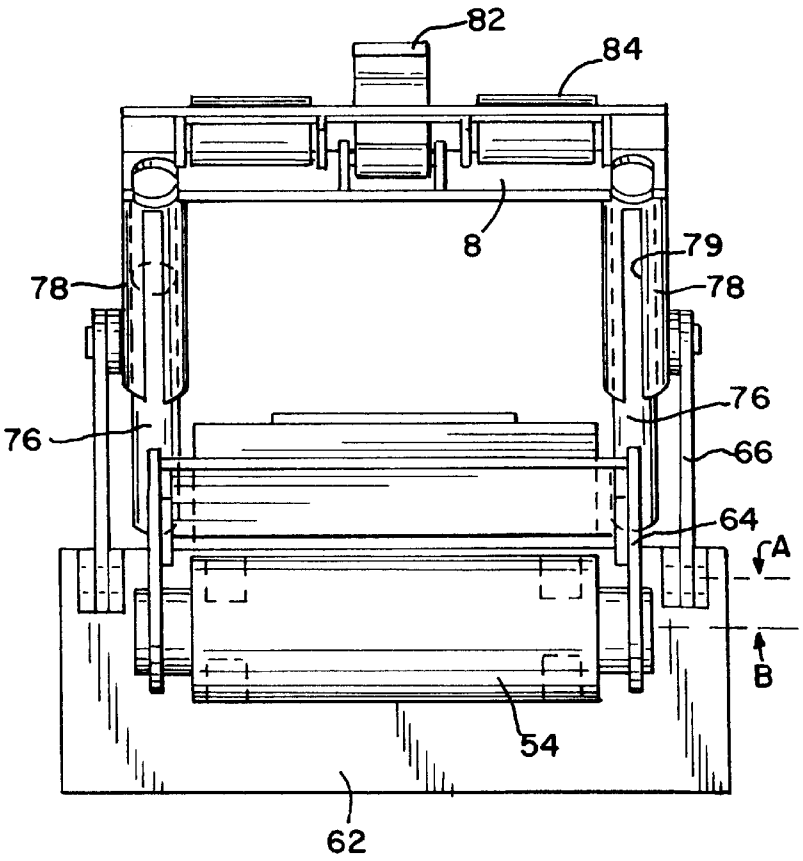
FIG. 5*a* is an elevational view of the lifter in FIG. 5.
Figure 5:
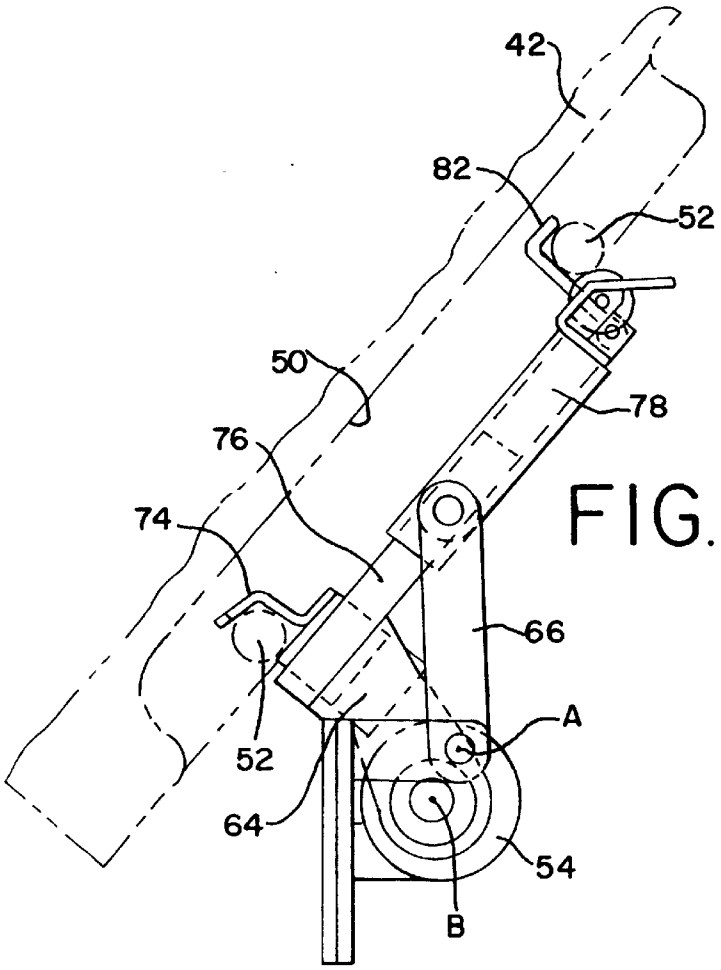
FIG. 5 is a side view of a lifter embodying the present invention in its extended position for lifting, tilting and dumping a refuse collection container that is shown partially in dashed lines.
Figure 6:
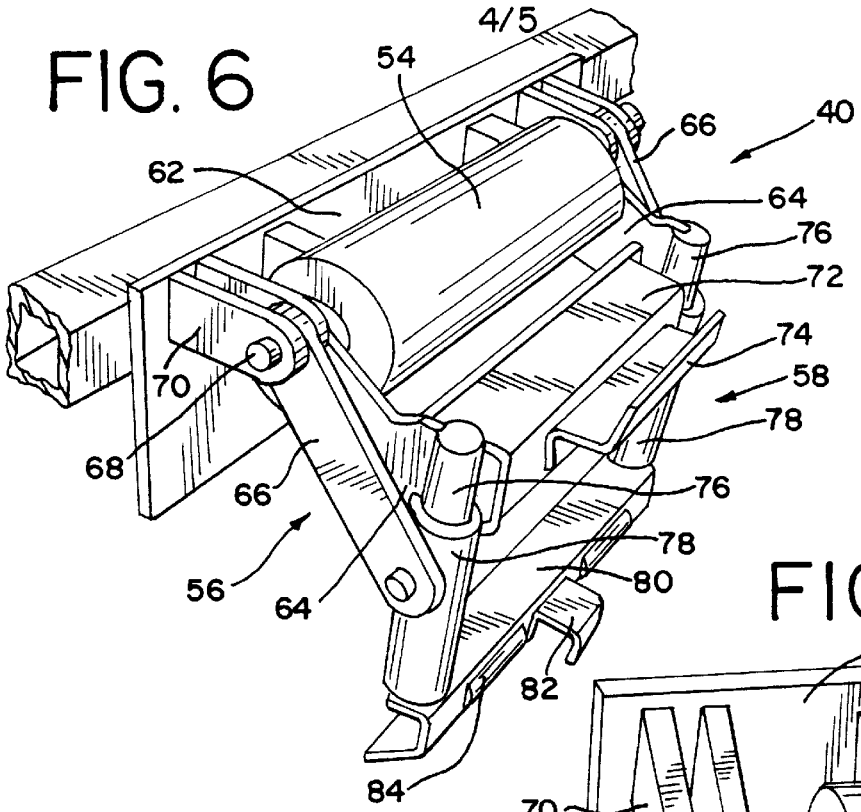
FIG. 6 is a perspective view of a lifter embodying the present invention.
Figure 7:
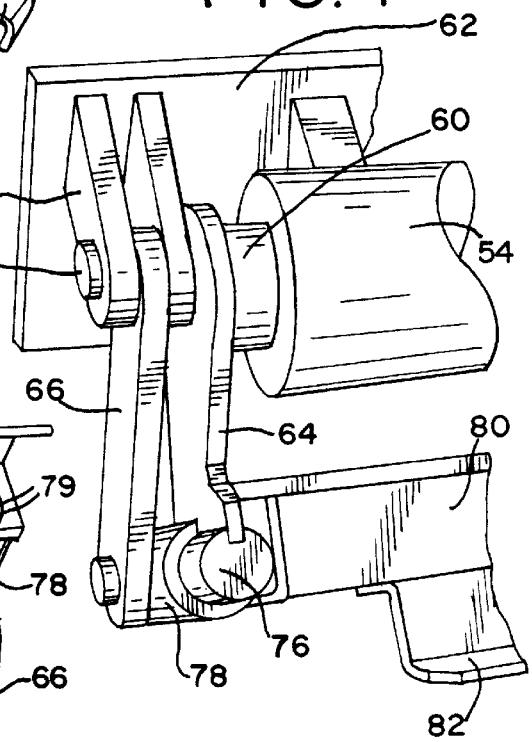
FIG. 7 is an enlarged perspective view, partially removed, of one side of the lifter of FIG. 6, depicting the lift and actuator linkages, hydraulic motor and carriage.

The lifter 40 embodying the present invention is perhaps best seen in FIG. 6, a perspective view of the lifter in an intermediate position between the retracted position (as in FIG. 3 and 3*a*) and the fully raised and inverted position (as in FIG. 5 and 5*a*). The lifter 40 of the present invention includes a rotary hydraulic motor or actuator 54, at least one lift arm and actuator arm generally at 56, and a container carriage, generally at 58. The hydraulic motor 54 has a generally horizontal rotary actuator shaft 60 (see FIG. 7) that extends through at least one end of the motor, and preferably through each end of the motor. The motor 54 may be of any suitable design. Most preferably, the motor or actuator is an HS series helical hydraulic shaft rotary actuator, as supplied by Helac Corporation of Enumclaw, Wash. These actuators are available in a variety of torque capabilities, and Model HS-15K is believed suitable for the present application. The motor 54 is attached, as by welding or bolting, to a mounting or base plate 62.

For lifting the container carriage, a lift arm 64 is attached to the actuator shaft 60 of the hydraulic motor 54, and preferably a lift arm is fixed to each end of the shaft. The other end of the lift arm is attached, as by welding, bolting or other attachment, to the carriage, as will be described in more detail later. For inverting the carriage, an actuator arm 66 is pivotally mounted at 68 to the base plate 62 at a location beyond the end of the motor actuator shaft. Each actuator arm 66 is pivotally mounted to a bracket 70 that is welded or otherwise attached to the base plate. As will be described in more detail later, the axis of rotation at the pivot 68 is displaced from and located above the axis of rotation of the motor actuator shaft. The other end of each actuator arm 64 is pivotally attached to the carriage, as discussed in more detail below.

The container carriage of the present invention may be of various constructions, such as an open frame, a solid face plate or other variations common in the lifter art. In the illustrated embodiment of the present invention, the carriage includes an upper cross member 72 that carries a hook or saddle 74 that serves to hook under the uppermost lift bar 52 on the refuse container 42 as the lifter is moved from the retracted to the extended position. Each end of the upper cross member 72 is welded or otherwise attached, directly or indirectly, to a lift arm 64 so that as the lift arm is rotated by the hydraulic motor 54, the cross member 72 is also raised or lowered.

Each side of the carriage in the illustrated embodiment includes two relatively movable or telescoping members 76 and 78. These members could be provided separately from the carriage, but making them part of the carriage reduces the number of parts and thus the material and labor costs. Inner telescoping member 76, as illustrated, is a solid cylindrical steel rod, and is attached directly or indirectly to the end of the lift arm 64 as, for example, by welding. Outer telescoping member 78, as illustrated, is a steel sleeve or tube including a slot 79 and is pivotally attached to the end of the actuator arm 66. A lower cross member 80 of the carriage extends between and is attached to each of the outer telescoping members 78. The lower cross member 80 includes a downwardly facing hook or saddle 82 for engaging over the lowermost lift bar 52 of a refuse collection container 42.

Figure 3:
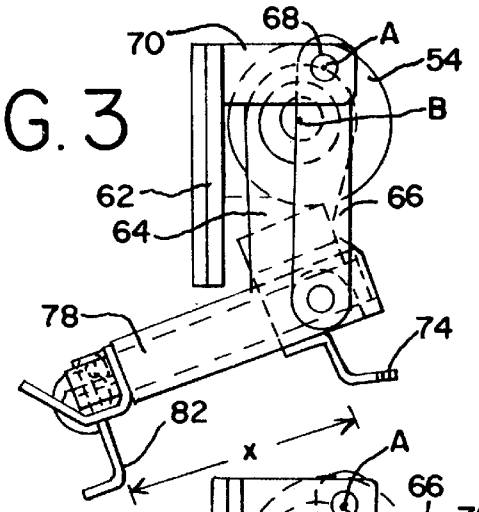
FIG. 3 is a side view of a lifter embodying the present invention in its retracted position.
Figure 4:
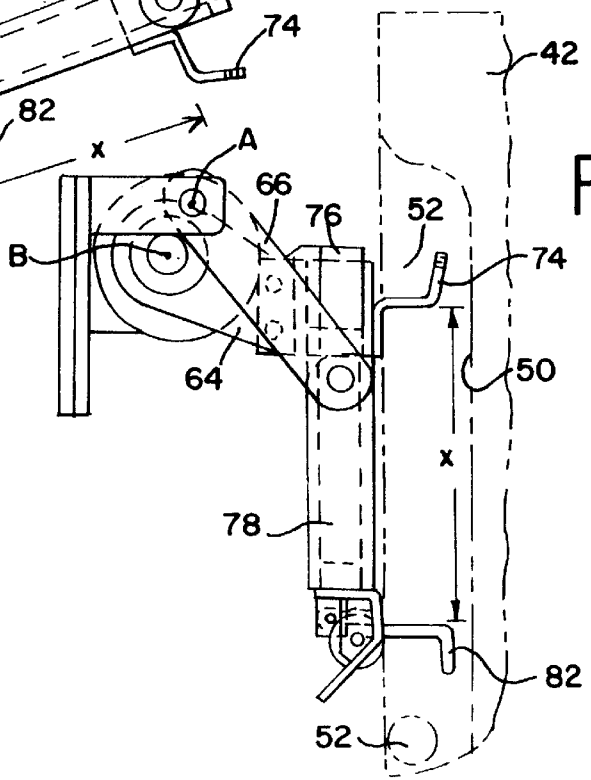
FIG. 4 is a side view of a lifter embodying the present invention in an intermediate position, with a refuse container shown partially in dashed lines.

As a result of the relatively movable arrangement between members 76 and 78, and the displaced axes of the pivot 68 and motor drive shaft 60, the spacing between the upper and lower cross members 72 and 80 varies depending on the rotational position of carriage. Turning to FIGS. 3–5, FIG. 3 is a side view of the lifter assembly when the carriage is in the fully retracted position. As may be seen there, the axis of rotation A of the pivot 68 is located above and slightly rearward of the axis of rotation B of the hydraulic motor rotary actuator shaft. In the fully retracted position, as shown in FIG. 3, the relatively movable members 76 and 78 are telescoped together, thereby reducing the distance X between the upper hook or saddle 74 and lower hook or saddle 82. As best seen in FIGS. 3*a,* 5*a* and 8, the outer member 78 includes the slot 79 at the rear to receive the lift arm 64 in the retracted position and allow the members 76 and 78 to fully telescope together to reduce the distance between the upper and lower hooks 74 and 82.

As the rotary actuator 54 rotates counterclockwise, the carriage moves from the fully retracted position to an intermediate position such as shown FIG. 4. This displaced axes of the pivot 68 and motor actuator shaft 60 causes the actuator arm 66 to push against the outer member 78, causing it to slide downwardly relative to the inner member 76, and increasing the spacing X between the upper saddle or hook 74 and the lower saddle or hook 82. In the position illustrated in FIG. 4, the upper and lower hooks 74 and 82 extend into the recessed area 50 of the container and are located between the lift bars 52, with the upper saddle or hook 74 engaging under and beginning to lift the upper lift bar 52 of the refuse collection container 42, and the lower hook being located above lower lift bar of the refuse container.

As the lifter 40 continues to rotate upwardly, the upper hook 74 lifts the refuse container, and continued upward rotation of the lifter also results in the actuator arms 66 continuing to push the lower hook away from the upper hook (due to the displaced axes of the pivot and the motor shaft) so that the lower hook engages over the lower lift bar of the collection container, to the position generally shown in FIG. 5. At the position shown in FIG. 5, the weight of the container has generally shifted such that the lower bar of the collection container rests against the lower hook or saddle 82 of the lifter. At this point, the distance between the upper and lower hooks or saddles are such as to effectively capture the refuse collection container on the lifter so that the refuse container cannot fall from the lifter. More specifically, the upper and lower hooks are spaced apart nearly the same distance that the upper and lower lift bars of the refuse container are spaced apart, so that the container cannot shift enough that either lift bar can be removed from its respective hook. The relative motion of the hooks or saddles is reversed as the lifter rotates back toward the retracted position, with the inner and outer members 76 and 78 sliding or telescoping together, drawing the cross members 72 and 80, and their respective hooks, closer together for release of the container.

As noted earlier, the container carriage, with relatively movable hooks, could be a separate assembly operatively attached to the relatively movable members 76 and 78 for moving the hooks. In the illustrated embodiment the relatively movable members 76 and 78 are directly attached, respectively, to the cross members 72 and 80, which tends to reduce cost and simplify construction.

Because the height or length of the carriage actually shortens as it moves from the extended position to the retracted position, it is particularly useful on refuse collection trucks of the type using a tipper or kick bar 34 as illustrated in FIG. 1. In other words, the length of the lifter is sufficiently reduced as it moves to the retracted position so that it can pass over the tipper bar and not interfere with the use of the tipper bar for dumping substantially larger multi-yard containers or dumpsters. In addition, as is apparent in FIG. 3, when the lifter is in the retracted position, the entire carriage 58 is located below and substantially forward of the rearward-most edge of lifter. This aids in providing a thin profile when the lifter to be mounted to the rear of refuse collection trucks that are also used in handling commercial collection chores.

In residential collection, the tipper bar or other lifting device for the large multi-yard containers typically would not be used, and the roll out residential carts would be lifted, tilted and dumped by the lifter 40 of the present invention. However, should the collection truck need to stop at a commercial location where a large multi-yard container needs to be dumped, lifter 40 would be rotated to the fully retracted position, such as shown in FIG. 3, where it will not interfere with the rotation of the tipper bar, and will provide a sufficiently thin profile that would allow the large containers to be dumped over the lifter without damaging the carriage of the lifter 40.

There are variety of techniques used for mounting lifters on the side or rear of refuse collection trucks area, some of which provide more protection to the lifter than others. For example, refuse collection trucks as delivered from a manufacturer, typically have a rearward-most reinforcing member along the hopper lip, which is commonly referred to as the sill or sill beam. Although not usually recommended by the manufacturer, lifters such as the present invention may be mounted in recesses cut into the sill to recess the motor and other parts of the lifter and better protect them from damage during dumping of much larger collection containers. Alternatively, a so-called sill extender may be mounted to the original sill, and the dump or lifter mounted within recesses in the sill extender. Alternatively, the lifter may be mounted directly on the original sill, and small bumpers placed on either side to help protect the lifter. The effect is similar, the lifter motor and other parts are better protected from damaging contact with the large multi-yard containers when they are dumped. The lifter of the present invention also may be mounted to the rear of trucks without using any of the above techniques, with the thin profile allowing large containers to be dumped, and the carriage being protected from damage due to its very compact retracted position. As can be seen in FIG. 3, the carriage 58 of the lifter 40 of the present invention, when in the retracted position, extends in a generally forward, almost horizontal position below the hopper and below any sill, sill extender, frame member or other surface to which lifter is mounted. In this retracted position, the lift arms 64 and actuator arms 66 extend generally vertically, providing for a very compact lifter, with minimum exposure of the lifter to potential damage from the lifting of large refuse collection containers by a tipper bar or by such other lifting device, such as a cable and winch, as may be used on the particular collection vehicle.

In addition to the hook 82, the lower cross member 80 also mounts a pair of rollers 84 to protect the wall of the container as it is lifted, tilted and dumped. As noted earlier, the hooks 74 and 82 extend into the recessed area 50 of the collection container and the rollers serve to support the container wall to prevent gouging by the lower hook or damage to the container as the lower hook moves downwardly during rotation of the carriage. In addition, the lower hooks 82 may be spring loaded to permit a degree of flexing in the event that the hook should engage against the wall of the container.

Figure 8:
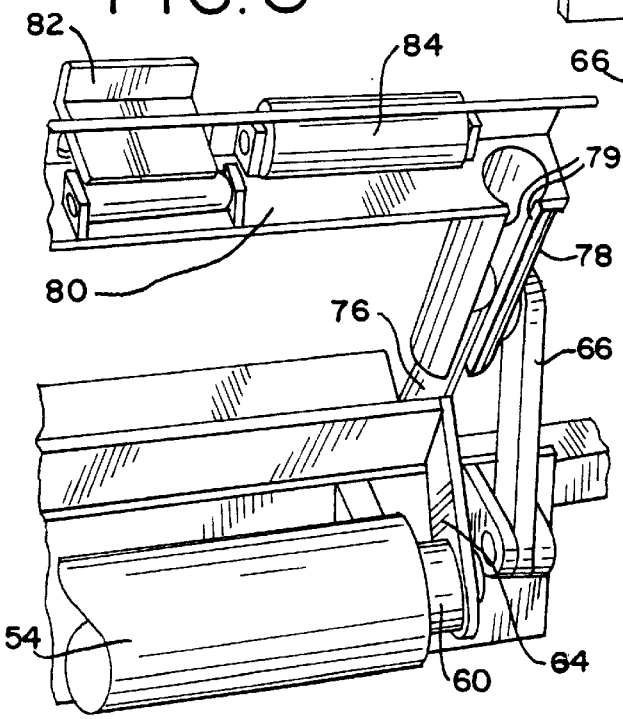
FIG. 8 is a perspective view of the lifter of FIG. 6 with the lifter in a raised position as it would be for lifting, tilting and dumping refuse containers.
Figure 11:
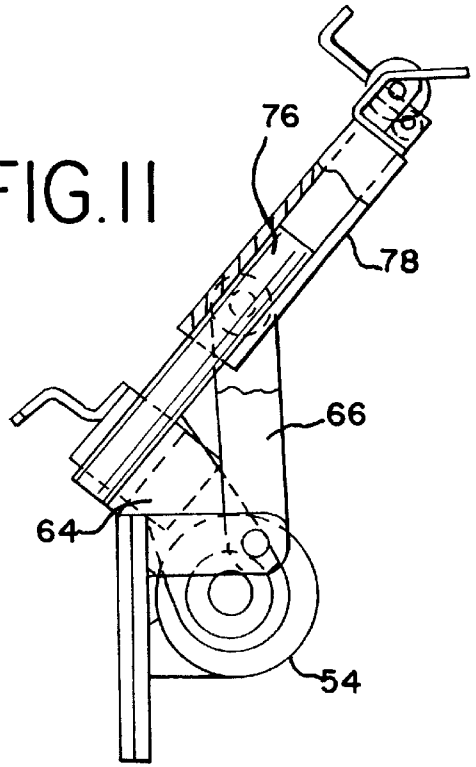
FIG. 11 is a side view of the lifter assembly of the present invention, in a raised and inverted position comparable FIG. 5, partially in section.
Figure 10:
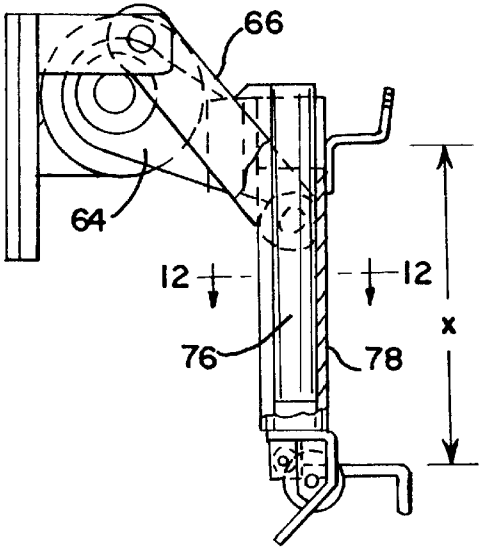
FIG. 10 is a side view of the lifter assembly of the present invention, in an intermediate position comparable to FIG. 4, partially in section.
Figure 9:
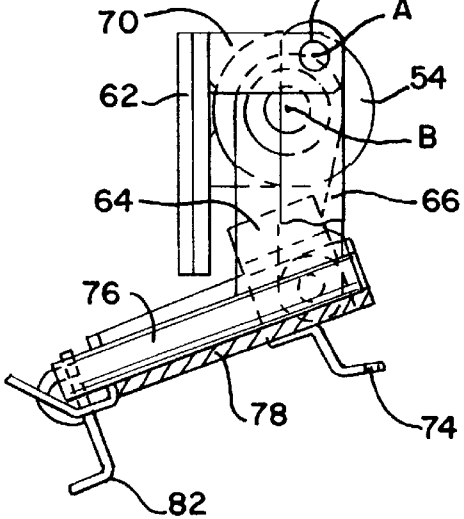
FIG. 9 is a side view of the lifter assembly of the present invention, in a retracted position comparable FIG. 3, partially in section.
Figure 15:
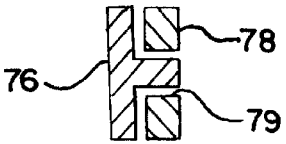
FIG. 15 is a cross sectional view taken along line 12—12 in FIG. 10, but of another alternative embodiment of the present invention.
Figure 14:
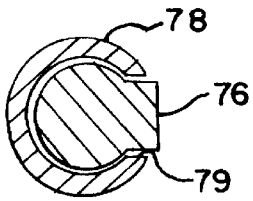
FIG. 14 is a cross sectional view taken along line 12—12 in FIG. 10, but of another alternative embodiment of the present invention.
Figure 13:
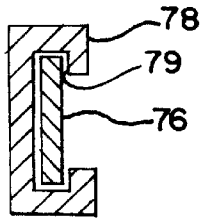
FIG. 13 is a cross sectional view taken along line 12—12 in FIG. 10, but of a further alternative embodiment of the present invention.
Figure 12:
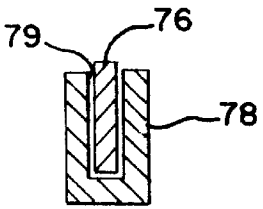
FIG. 12 is a cross sectional view taken along line 12—12 in FIG. 10, but of an alternative embodiment of the present invention.

Although the lifter 40 is shown in its preferred embodiment, various modifications may be made without departing from the invention. Referring to FIG. 8, which depicts the lifter in a raised and inverted position, the slot in the outer member 78, for receiving the lift arm in the retracted position, is readily apparent. As illustrated, the slot extends the full length of the outer member 78. However, because the lift arm only enters the upper portion of the slot, the lower portion of the slot is unnecessary and the outer member 78 may be continuous and free of a slot in the lower portion, for example the lower half, for increased strength and durability.

Also, in the illustrated and preferred embodiment, the inner member 76 is a solid cylindrical steel rod and the outer member 78 is a hollow steel sleeve in which the steel rod slidably moves. Other arrangements or configuration for members 76 and 78 may be used which allow for relative motion without departing from the present invention. For example, the members 76 and 78 could be of any other shape, such as c-shaped or u-shaped or simply flat shaped as illustrated, for example, in FIGS. 12–15, provided that relative movement may be achieved between the two members to cause, directly or indirectly, relative movement between the upper and lower hooks or saddles 74 and 82.

Other variations may also be apparent upon further study. While the invention has been described in terms of certain preferred embodiments, there is no intent limited to the same. Instead, the scope of the invention is defined by the appended claims.

What is claimed:

1. A lifting device for moving a container between a first and a second position relative to a base, the container having a body with first and second bars secured thereto in spaced parallel relationship, the device comprising:

(a) a motor secured to the base, the motor having a shaft rotatable about a first axis;

(b) at least one lift arm having first and second ends, the first end being secured to the shaft;

(c) at least one actuator arm having first and second ends, the first end being pivotally mounted to the base for rotation about a second axis displaced from the first axis;

(d) a carriage having a first hook for selectively engaging the first bar on the container and the second hook for engaging the second bar on the container so as to secure the container to the carriage as the container is moved between the first and second positions, the first hook and second hook being connected to each other by a telescoping member having first and second ends, the first end of the telescoping member being rigidly connected to the second end of the lift arm and the second end of the telescoping member being pivotally connected to the second end of the actuator arm so that the first end of the telescoping member moves away from the second end of the telescoping member as the container is moved from the first to the second position and the first end of the telescoping member moves toward the second end of the telescoping member as the container is moved from the second position to the first position.

2. The lifting device of claim 1 wherein the telescoping member comprises an inner member secured to the lift arm and an outer member secured to the actuator arm, the outer member including a longitudinal slot sized so that at least a portion of the actuator arm retracts into the slot when the lifting device is in the first position.

3. The lifting device of claim 1 wherein each hook member has a roller associated therewith for engaging the container as it is lifted between the first and second positions.

4. A lifting device for moving a container between a first and a second position relative to a base, the container having a body with first and second bars secured thereto in spaced parallel relationship, the device comprising:

(a) a motor secured to the base, the motor having a shaft rotatable about a first axis;

(b) at least one lift arm having first and second ends, the first end being secured to the shaft;

(c) at least one actuator arm having first and second ends, the first end being pivotally mounted to the base for rotation about a second axis displaced from the first axis;

(d) a carriage comprising a first cross piece rigidly mounted to the lift arm and including a first hook for selectively engaging the first bar on the container, a connecting member rigidly secured to the lift arm and pivotally secured to the actuator arm, and a second cross piece rigidly connected to the connecting member and including a second hook for selectively engaging the second bar on the container.

5. The lifting device of claim 4 wherein the connecting member comprises an inner member secured to the lift arm and an outer member secured to the actuator arm, the outer member including an elongated slot sized so that at least a portion of the actuator arm retracts into the slot when the lifting device is in the first position.

6. The lifting device of claim 4 wherein each hook member has a roller associated therewith for engaging the container as it is lifted between the first and second positions.

7. A lifting device for lifting and inverting a refuse collection container, the device including:

a base;

a rotary actuator carried by the base and including an output shaft rotatable about a first axis;

at least one lift arm having first and second ends, the first end being attached to the output shaft;

at least one actuator arm having first and second ends, the first end being pivotally carried by the base for rotation about a second axis displaced from the first axis;

the second end of the lift arm carrying a first container-engageable member;

the second end of the actuator arm carrying a second container-engageable member; and a telescoping member including first and second relatively movable elements, the second end of the lift arm being attached to a first one of the elements and the second end of the actuation arm being attached to the second of the elements, whereby the first and second container-engageable members are linearly movable toward or away from one another as the actuator arm is rotated by the output shaft.

8. A lifting device in accordance with claim 7 in which the first one of the elements comprises an inner member and the second one of the elements comprises an outer hollow member slidably receiving the inner member.

9. A lifting device in accordance with claim 7 in which the inner member is generally cylindrical and the outer member is a generally cylindrical sleeve.

10. A lifting device in accordance with claim 7 in which the first and second elements mechanically interfit to limit relative movement of the first and second elements to linear movement between retracted and extended positions.

11. A lifting device in accordance with claim 7 in which the second container-engageable member is carried by the second one of the telescoping member elements.

12. A lifting device in accordance with claim 11 including a cross member carried by the second one of the telescoping member elements and the second container-engageable member is attached to the cross member.

13. A lifting device in accordance with claim 12 including a second cross member carried by the lift arm and the first container-engageable member is attached to the second cross member.

14. A lifting device for lifting and inverting a refuse collection container, the device including:

a base;

a rotary actuator carried by the base and including an output shaft rotatable about a first horizontal axis, the output shaft having opposed ends;

a lift arm attached to each end of the output shaft, each lift arm having first and second ends, the first end being attached to the output shaft for rotation about the horizontal axis;

at least two actuator arms, each having first and second ends, the first end of each actuator arm being pivotally carried by the base for rotation about a second axis displaced from the first axis, the rotary actuator and lift arms being located between the actuator arms to define a lift arm and actuator arm pair in proximity to each end of the actuator output shaft;

at least two telescoping members, each of which includes first and second elements relatively movable between an extended position and a retracted position, each telescoping member being attached to one of said lift and actuator arm pairs, with the second end of the respective lift arm being attached to a first one of the telescoping member elements and the second end of the respective actuator arm being attached to a second one of the telescoping member elements;

a cross member extending between said lift arms and carrying a first container-engageable member;

another cross member extending between the second one of each of the telescoping member elements and carrying a second container-engageable member;

whereby, upon rotation of the output shaft of the rotary actuator, the container-engageable members are rotated between a retracted position and a raised and inverted position for lifting, inverting and dumping refuse collection containers, the container-engageable members will moving toward or away from each other as the lift arms are rotated by the actuator.

* * * * *